US006929164B1

(12) United States Patent
Thomas

(10) Patent No.: US 6,929,164 B1
(45) Date of Patent: Aug. 16, 2005

(54) NECK WRAP/BRACE FOR HOLDING ITEMS AND BELT ARTICLE HOLDER FOR SAME

(76) Inventor: Clarence Thomas, 111-35 207th St., Queens Village, NY (US) 11429

( * ) Notice: Subject to any disclaimer, the term of this patent is extended or adjusted under 35 U.S.C. 154(b) by 186 days.

(21) Appl. No.: 10/412,185

(22) Filed: Apr. 11, 2003

(51) Int. Cl.[7] ..... A45F 5/00

(52) U.S. Cl. ..... 224/575; 224/148.4; 224/250; 224/257; 224/600; 224/605; 224/680; 224/685; 224/901.4; 224/930

(58) Field of Search ..... 224/148.4, 148.7, 224/235, 236, 240, 241, 250, 251, 257, 575, 224/600, 660, 662, 663, 665, 676, 680, 682, 224/684, 930, 901.4; 379/430, 449

(56) References Cited

U.S. PATENT DOCUMENTS

| | | | | | |
|---|---|---|---|---|---|
| 1,368,261 | A | * | 2/1921 | Jenkins | 379/430 |
| 1,917,479 | A | * | 7/1933 | Whitley | 379/21 |
| 2,488,181 | A | * | 11/1949 | Fallek | 379/449 |
| 3,176,087 | A | * | 3/1965 | Schetzer | 379/430 |
| 3,664,560 | A | | 5/1972 | Perkins | |
| 4,327,853 | A | | 5/1982 | Adams | |
| 4,620,653 | A | * | 11/1986 | Farrell | 224/682 |
| 4,802,211 | A | * | 1/1989 | Huntley | 224/930 |
| 4,819,846 | A | | 4/1989 | Hannemann | |
| 5,207,362 | A | | 5/1993 | Janus et al. | |
| 5,240,158 | A | | 8/1993 | Walsh | |
| 5,346,111 | A | | 9/1994 | Huntley et al. | |
| 5,398,855 | A | * | 3/1995 | Schaiewitz | 224/257 |
| 5,407,113 | A | * | 4/1995 | Golliher | 379/430 |
| 5,450,991 | A | | 9/1995 | Neading | |
| 5,503,313 | A | * | 4/1996 | Wei | 224/600 |
| 5,570,824 | A | | 11/1996 | Lyon et al. | |
| 6,200,243 | B1 | * | 3/2001 | Meranto | 224/148.4 |
| 6,707,924 | B1 | * | 3/2004 | Okiebisu | 379/430 |
| 2002/0065115 | A1 | * | 5/2002 | Lindholm | 455/568 |

* cited by examiner

*Primary Examiner*—Gary E. Elkins
(74) *Attorney, Agent, or Firm*—Richard M. Goldberg

(57) ABSTRACT

A combination neck wrap/brace for holding items and belt article holder for carrying the same, includes a neck wrap/brace having a neck strap to be wrapped about a neck of a person. A first securing arrangement secures together opposite ends of the neck strap about the person's neck. A telephone holder is secured to the neck strap for holding a telephone adjacent the person's ear, to enable the person to use the telephone in a hands-free manner. A belt article holder includes a belt strap adapted to be wrapped about the person's waist. A second securing arrangement secures together opposite ends of the belt strap about the person's waist, and a neck wrap/brace holder on the strap holds the neck wrap/brace when the neck wrap/brace is not wrapped about the person's neck.

24 Claims, 10 Drawing Sheets

NECK WRAP/BRACE FOR HOLDING ITEMS AND BELT ARTICLE HOLDER FOR SAME

BACKGROUND OF THE INVENTION

The present invention relates generally to a neck wrap/brace to be worn by a person for carrying items. Traveling with many items, such as a telephone, pen or pencil, coins, cigarettes, etc., can be very cumbersome, particularly when all of the items need to be readily accessible. Often, these items are crammed into pockets and briefcases, thereby making the items not readily accessible.

Even further, a person with a disability with restricted movement, has an even more difficult time rendering these items readily accessible.

Although utility belts are known for holding various items, the utility belts cannot hold a telephone in a hands-free manner adjacent a person's ear.

A device for holding a telephone in a hands-free manner adjacent to a person's ear is known from U.S. Pat. No. 5,346,111 to Huntley et al. However, this arrangement is relatively complicated, and requires the use of a harness that sits upon the shoulders of the person, with a telephone holder extending upwardly therefrom.

SUMMARY OF THE INVENTION

Accordingly, it is an object of the present invention to provide a neck wrap/brace for holding items and belt article holder for the same that overcomes the problems with the aforementioned prior art.

It is another object of the present invention to provide a neck wrap/brace for holding items and belt article holder for the same that can also function as a neck brace for a person with disabilities or an injured person.

It is still another object of the present invention to provide a neck wrap/brace for holding items and belt article holder for the same which holds a telephone adjacent a person's ear for hands-free operation.

It is yet another object of the present invention to provide a neck wrap/brace for holding items that can be carried by a belt article holder when not in use.

In accordance with an aspect of the present invention, a neck wrap/brace for holding items, comprises a strap adapted to be wrapped about a neck of a person; a securing arrangement for securing together opposite ends of the strap in a loop configuration to be wrapped about the neck of the person; and a telephone holder secured to the strap for holding a telephone adjacent an ear of the person when the strap is wrapped about the neck of the person, to enable the person to use the telephone in a hands-free manner. The strap can function as a neck brace to provide additional support for a head of the person and to restrict movement of the head of the person.

Preferably, the securing arrangement includes a hook at a first end of the strap; and securing flaps at an opposite second end of the strap for securing together around the first end in order to trap the hook, thereby securing together the first and second ends of the strap. In this case, one of the securing flaps includes hook-like fasteners and the other of the securing flaps includes loop-like fasteners for releasably connecting with the hook-like fasteners. The securing arrangement further includes a band slidably secured around the strap for removably sliding over the secured together flaps.

The telephone holder includes a mounting member mounted to the strap; and a telephone holding member for holding the telephone and secured to the mounting member. The telephone holding member includes a band through which a telephone can be frictionally inserted and removably held therein. The mounting member includes a band slidably mounted on the strap for movement therealong in order to adjust the telephone with respect to a person's ear when the strap is wrapped about the neck of the person.

There is at least one additional article holder mounted to the strap. Preferably, the at least one additional article holder includes at least one of the following: a first article holder for holding at least one of money, candy, transportation cards, writing implements and cigarette lighters; and a second article holder for holding a pack of cigarettes. The at least one additional article holder is releasably secured to the strap.

In accordance with another aspect of the present invention, a combination neck wrap/brace for holding items and belt article holder for carrying the neck wrap/brace, comprises a neck wrap/brace including a neck strap adapted to be wrapped about a neck of a person, a first securing arrangement for securing together opposite ends of the neck strap in a loop configuration to be wrapped about the neck of the person, and a telephone holder secured to the neck strap for holding a telephone adjacent an ear of the person when the strap is wrapped about the neck of the person, to enable the person to use the telephone in a hands-free manner; and a belt article holder including a belt strap adapted to be wrapped about a waist of the person, a second securing arrangement for securing together opposite ends of the belt strap in a loop configuration to be wrapped about the waist of the person, and a neck wrap/brace holder on the strap for holding the neck wrap/brace when the neck wrap/brace is not wrapped about the neck of the person.

The second securing arrangement includes at least one first fastener at a first end of the second strap and at least one second fastener at a second end of the second strap for securing with the at least one first fastener at a connection position, thereby securing together the first and second ends of the second strap. Preferably, the at least one first fastener includes hook-like fasteners and the at least one second fastener includes loop-like fasteners for releasably connecting with the hook-like fasteners. The second securing arrangement further includes securing flaps at the second end of the second strap for securing together around the first end of the second strap.

The at least one first fastener is spaced away from an edge of the first end of the second strap and the at least one second fastener is spaced away from an edge of the second end of the second strap, such that the first and second ends extend outwardly as first and second end extensions in opposite directions from the connection position. Each end extension includes a securing arrangement for releasably connecting with the securing arrangement of the other end extension, to form the neck wrap/brace holder as a loop extension of the strap for holding the neck wrap/brace when the neck wrap/brace is not wrapped about the neck of the person.

There is also at least one first additional article holder mounted to at least one of the first strap and the second strap. Preferably, the at least one additional article holder includes at least one of the following: a first article holder for holding at least one of money, candy, transportation cards, writing implements and cigarette lighters; a second article holder for holding a pack of cigarettes; a third article holder for holding writing paper; and a fourth article holder for holding a bottle. It is also preferable that the at least one additional article holder is removably secured to at least one of the first strap and the second strap.

The above and other objects, features and advantages of the invention will become readily apparent from the following detailed description thereof which is to be read in connection with the accompanying drawings.

DETAILED DESCRIPTION

Figure 1:
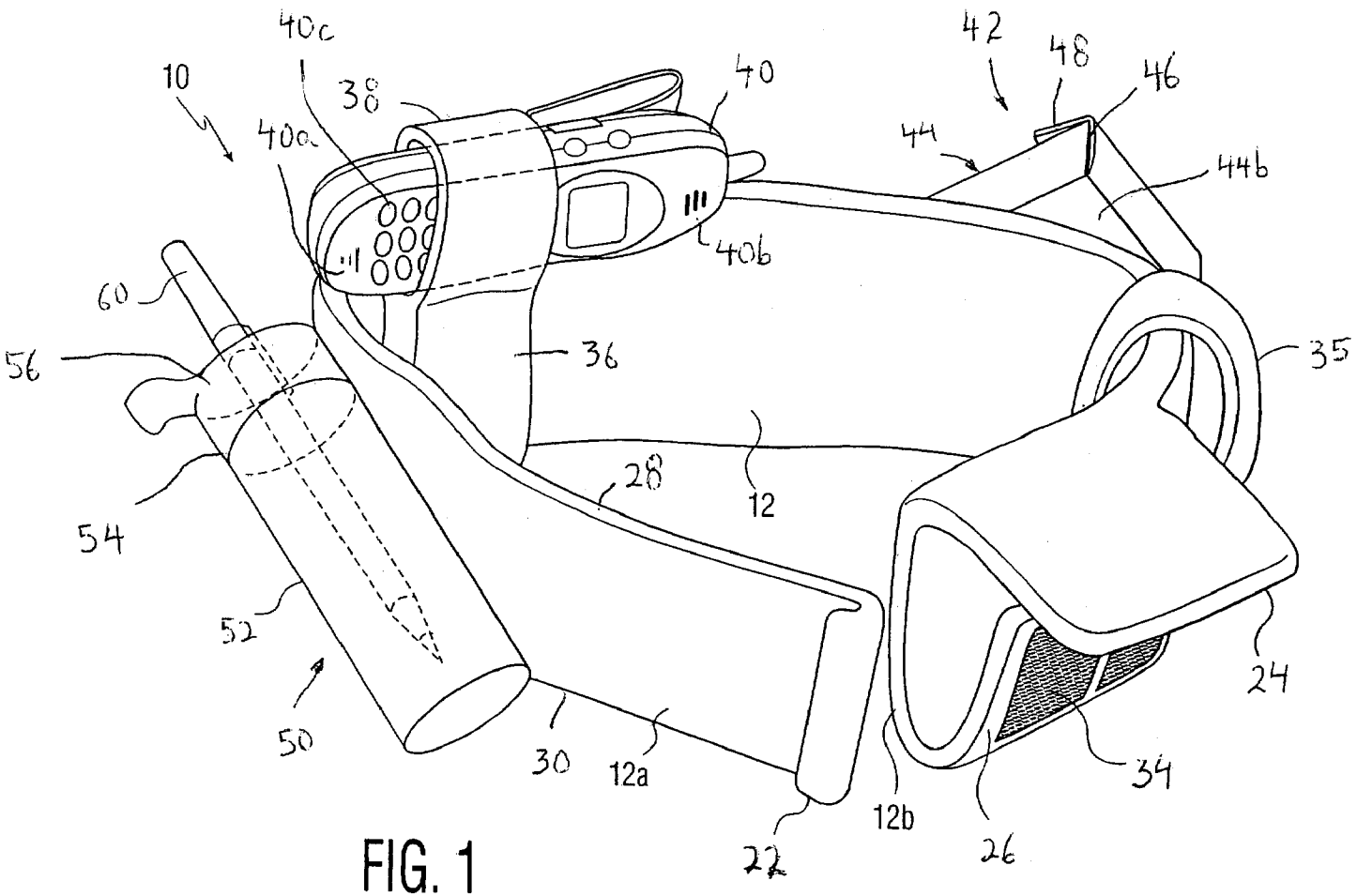
FIG. 1 is a perspective view of a neck wrap/brace for holding items according to the present invention.
Figure 2:
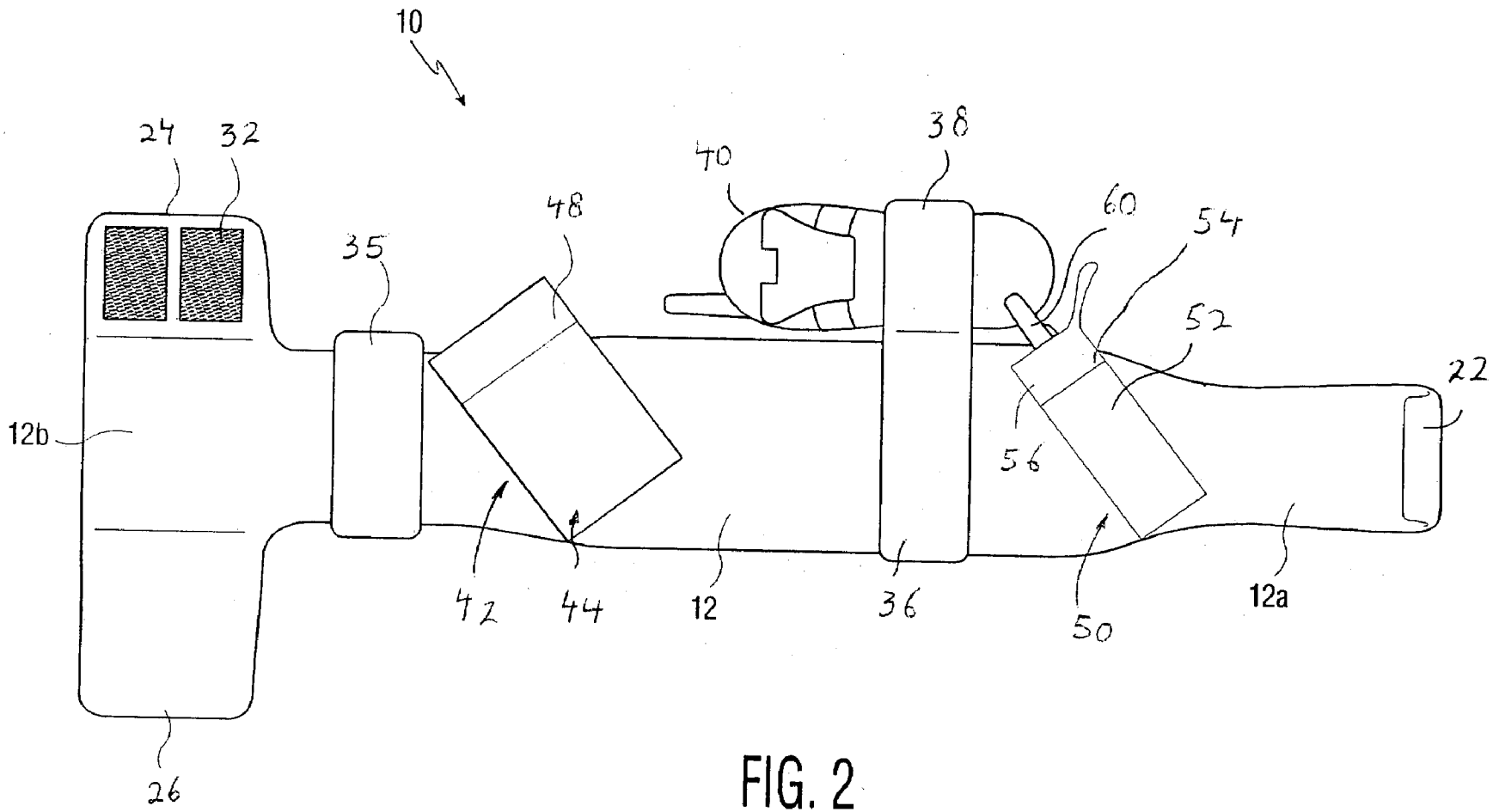
FIG. 2 is a rear plan view of the neck wrap/brace.
Figure 3:
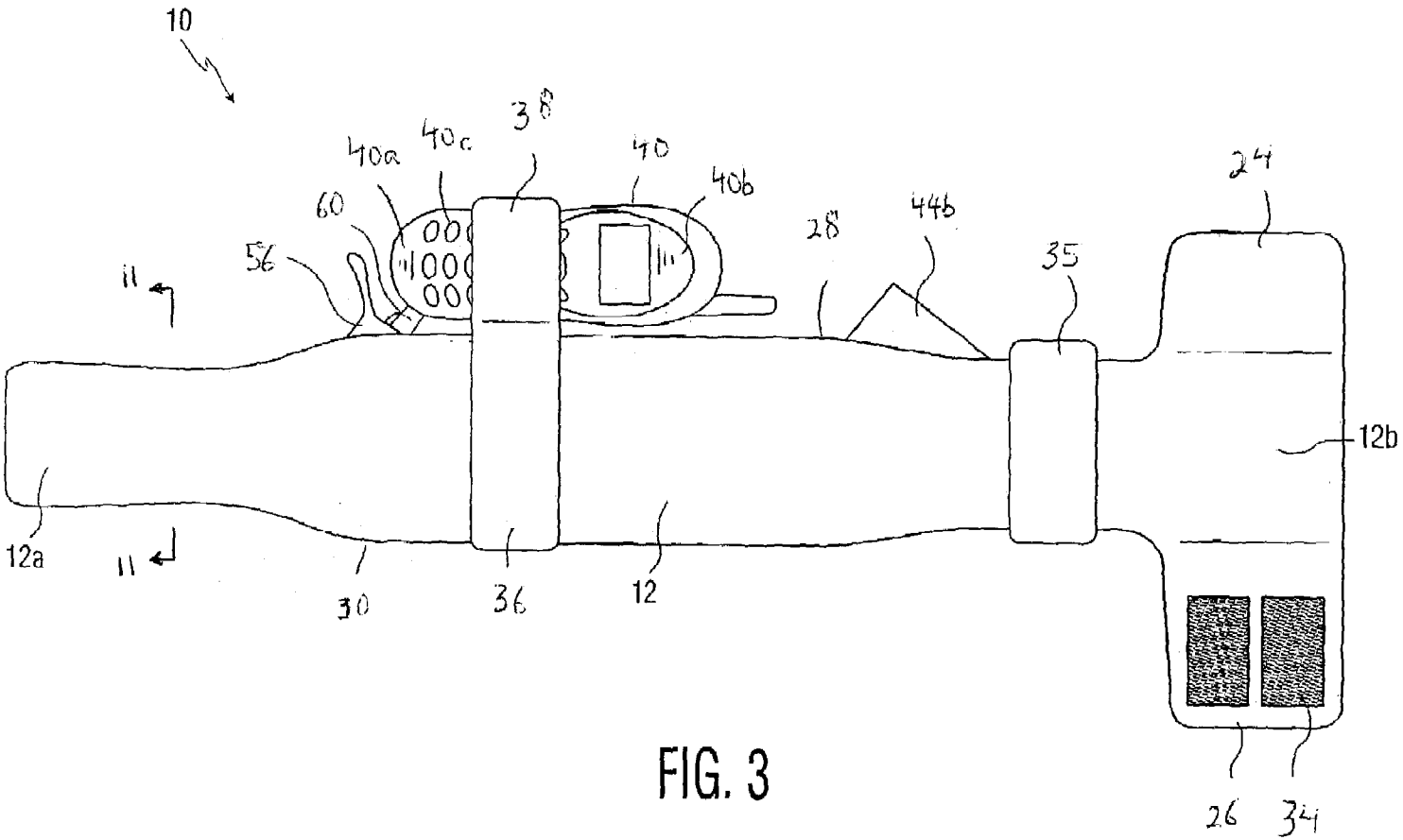
FIG. 3 is a front plan view of the neck wrap/brace.
Figure 4:
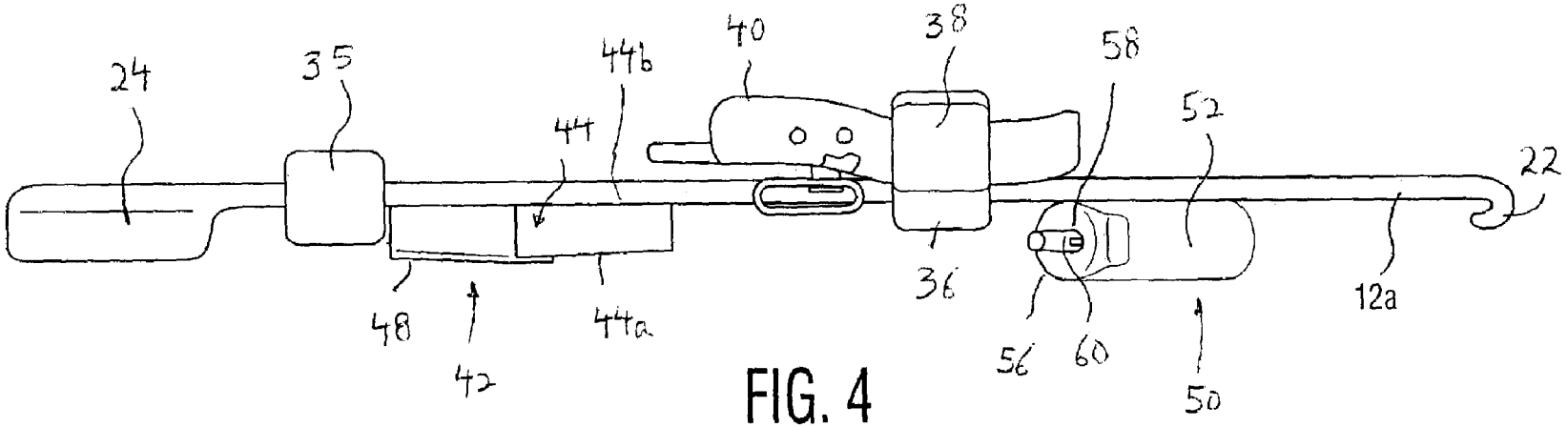
FIG. 4 is a side elevational view of the neck wrap/brace.
Figure 5:
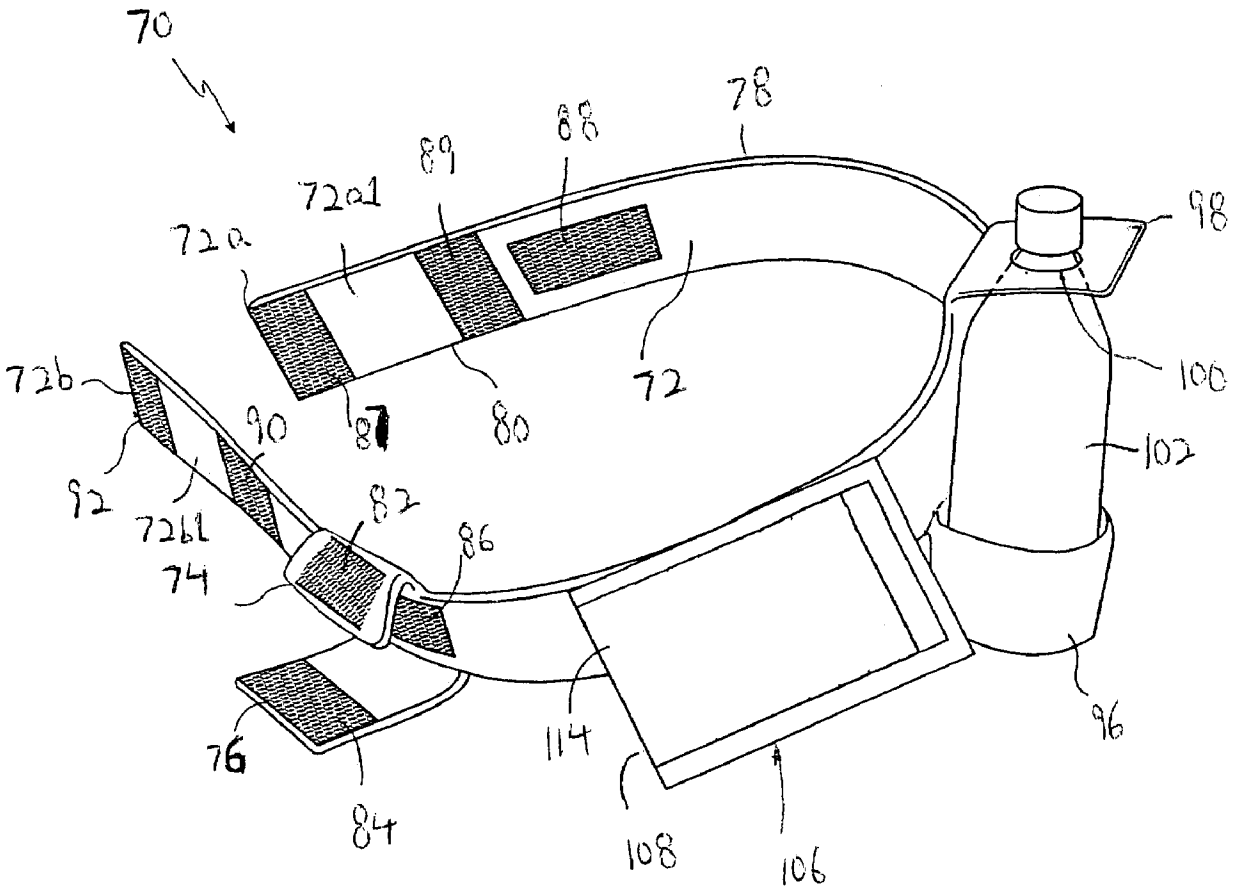
FIG. 5 is a perspective view of the belt article holder.
Figure 6:
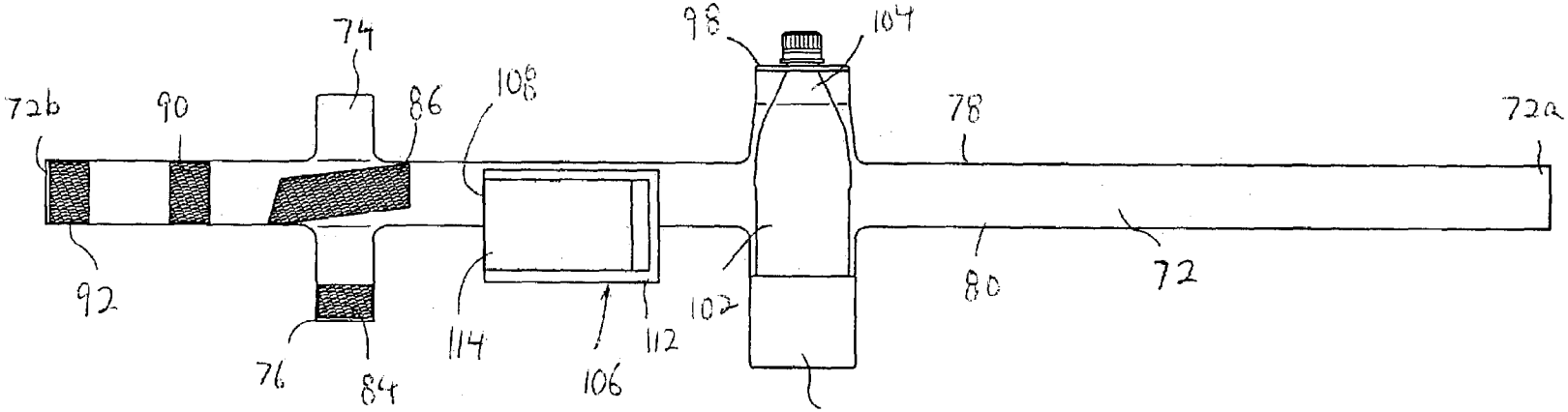
FIG. 6 is a rear plan view of the belt article holder.
Figure 7:
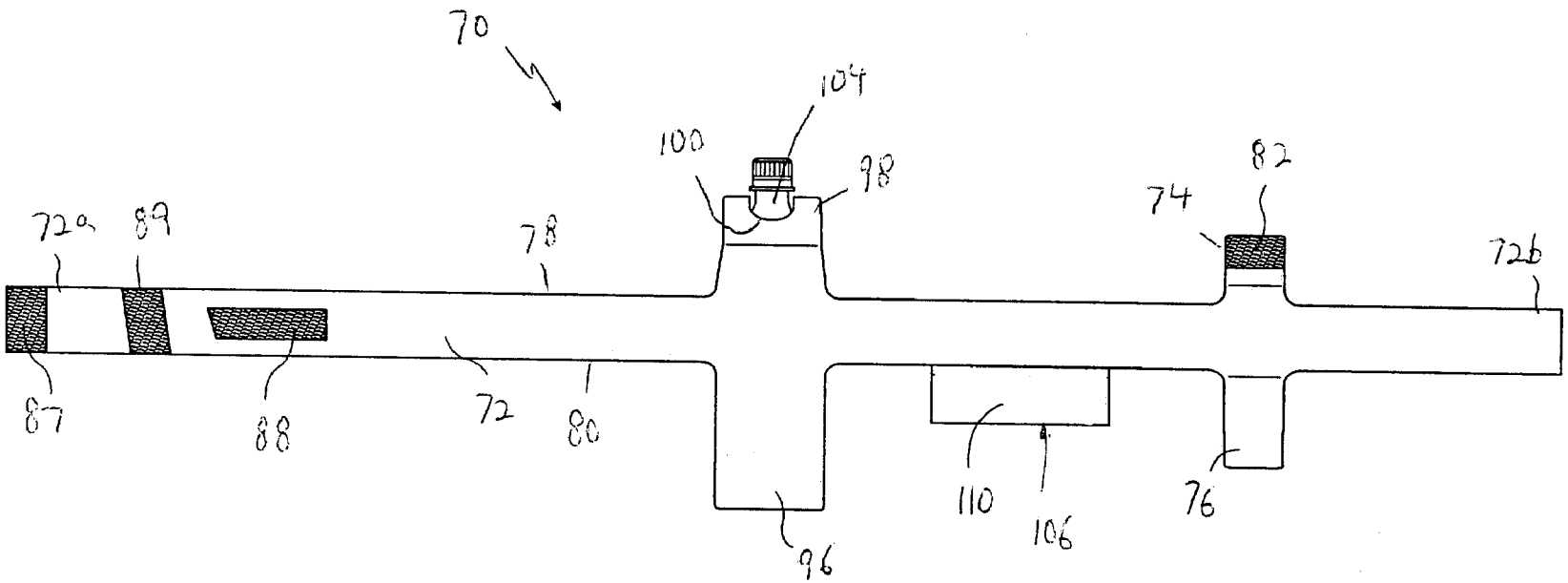
FIG. 7 is a front plan view of the belt article holder.
Figure 11:
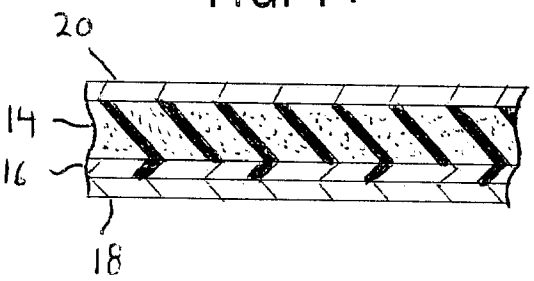
FIG. 11 is an enlarged cross-sectional view of the neck wrap/brace, taken along line 11—11 of FIG. 3.
Figure 8:
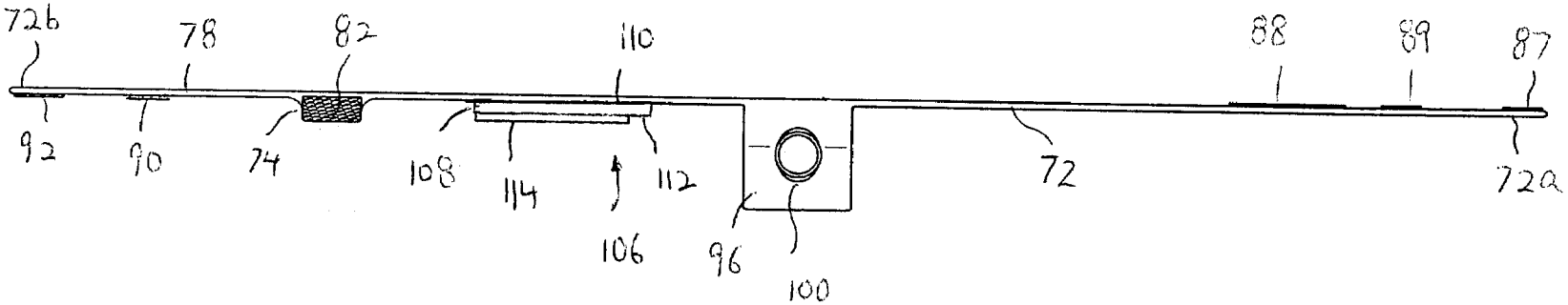
FIG. 8 is a side elevational view of the belt article holder.

Referring to the drawings in detail, and initially to FIGS. 1–4 and 9, a neck wrap/brace 10 according to the present invention, for holding items, such as a telephone, pen or pencil, coins, cigarettes, etc., is formed by a strap 12 of material that can be bent into a desired shape and which remains in that shape until bent again. As shown by the cross-sectional view of FIG. 11, strap 12 is preferably formed by a center layer 14 of a foam material, a first outer layer 16 of a stiffener material, such as a fiber or plastic material that retains the shape into which it is bent, adhered to the outer surface of center layer 14, an outer covering layer 18 of a vinyl or other protective material, adhered to the outer surface of first outer layer 16, and an inner covering layer 20 of a vinyl or other protective material, adhered to the inner surface of center layer 14. Preferably, covering layers 18 and 20 are water repellent. It will be appreciated, however, that the present invention, is not limited thereby, and any other suitable arrangement of layers can be used.

Strap 12 preferably has a generally constant width along the length thereof, although it can taper to a reduced width at a-first end 12*a* thereof. Further, at end 12*a*, a short length of strap 12 is bent back on itself to the outside, to form a hook 22, the purpose for which will become apparent from the discussion hereafter.

The opposite second end 12*b* of strap 12 is formed with transverse rectangular flaps 24 and 26 that extend from upper and lower edges 28 and 30, respectively, of strap 12. Flap 24 is formed with at least one patch 32 of loop-type fasteners commonly sold under the trademark VELCRO on the inner surface thereof, while flap 26 is formed with at least one patch 34 of hook-type fasteners commonly sold under the trademark VELCRO on the outer surface thereof, for releasably connecting with the loop-type fasteners of patch 32.

Figure 9:
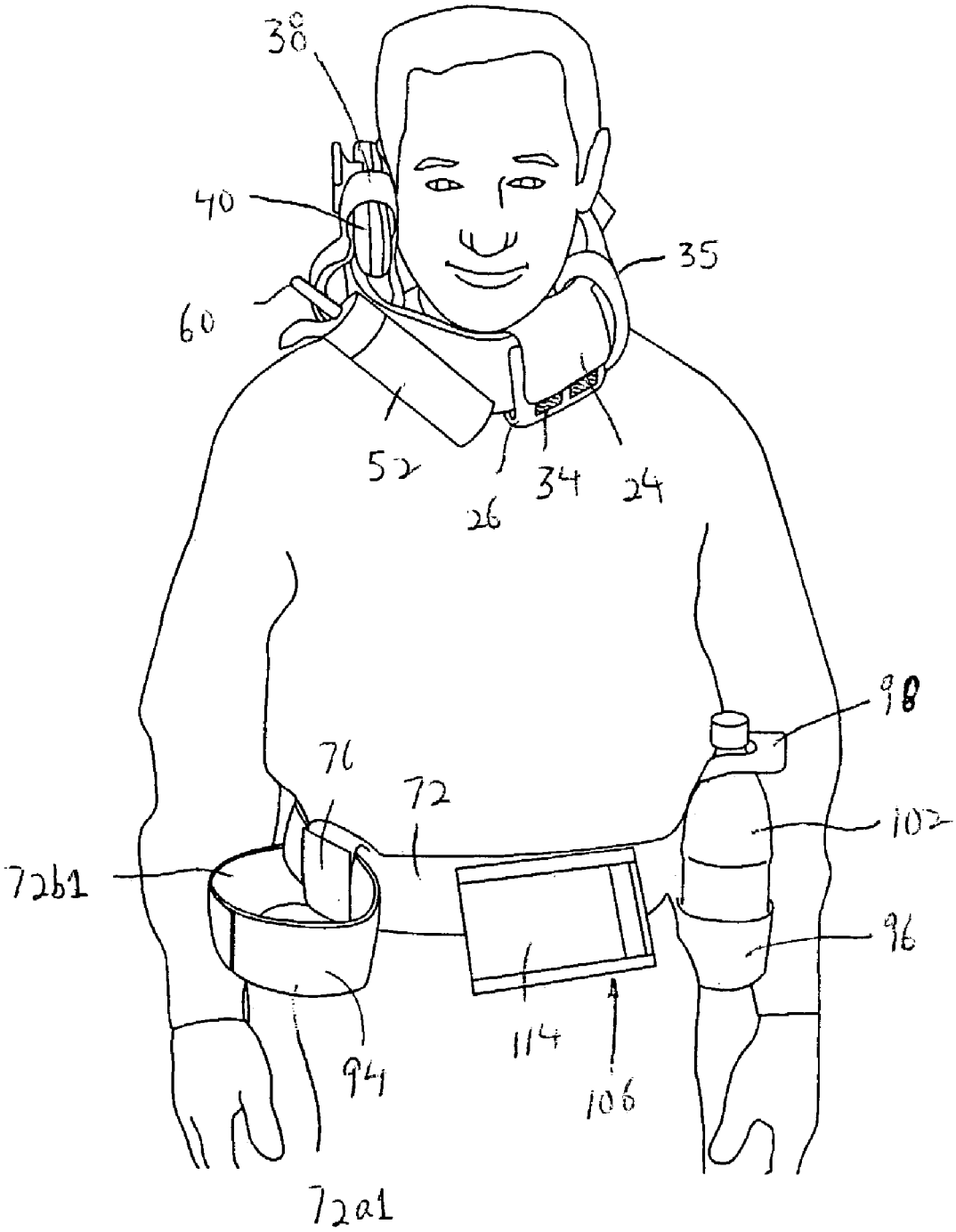
FIG. 9 is a perspective view of the neck wrap/brace for holding items and belt article holder for the same being worn by a person.

In this manner, as shown in FIG. 9, when strap 12 is positioned around the neck of a person, first end 12*a* is positioned across the outer surface of second end 12*b* so as to extend through the unsecured flaps 24 and 26. Then, flaps 26 and 28 are releasably secured together by patches 32 and 34, over first end 12*a*. Hook 22 functions to engage the edges of flaps 24 and 26 to prevent escape of first end 12*a* from the secured flaps 24 and 26.

A securing band 35 is also slidably positioned on strap 12, and is adapted to slide over the secured flaps 24 and 26 to prevent inadvertent separation thereof, so as to positively retain first end 12*a* therein. Band 35 is not shown slid over flaps 24 and 26 in FIGS. 9 and 10 for the sake of clarity in the drawings, but will be slid thereover in use.

In one embodiment, strap 12 functions as a neck brace for the person, in order to provide additional-support for the person's head and/or restrict movement of the person's head, particularly where there has been a neck injury or where there is a disability.

Neck wrap/brace 10 further includes various article holding devices secured to strap 12 for holding different articles. Thus, a first band 36 is slidably mounted on strap 12 for movement therealong. However, the sliding movement is provided against a friction force between band 36 and strap 12 so that band 36 remains in position and does not freely move from the desired position, absent an external force applied thereto. A second relatively stiff, but slightly flexible, band 38 is secured to the upper end of band 36, and is adapted to receive a portable or cellular telephone 40 therethrough such that the mouthpiece 40*a* which contains a microphone and earpiece 40*b* which contains a speaker, of telephone 40, extend out from opposite sides of band 38. In addition, the numerical push-buttons 40*c* of telephone 40 also extend to one side of band 38. An insert band (not shown) can be slidably inserted within band 38 for receiving a smaller size telephone.

Bands 36 and 38 are arranged so that earpiece 40*b* is positioned adjacent a person's ear and mouthpiece 40*a* is positioned adjacent a person's mouth, to provide a hands-free operation of telephone 40. This is particularly advantageous for invalids and injured persons, and it is useful also for persons who are not infirm and merely desire a convenient hands-free operation of telephone 40.

Another article holding device of neck wrap/brace 10 is a cigarette pack holder 42 which is secured to the outer surface of strap 12. Cigarette pack holder 42 is formed as a generally rectangular parallelepiped box 44 having an open upper end 46 through which a cigarette pack (not shown) can be inserted and held therein, with a closure flap 48 hinged to the upper end of box 44. Closure flap 48 can be releasably secured to the outer facing surface 44*a* of box 44 by any suitable means, such as the hook and loop fastener arrangement sold under the trademark VELCRO, a snap arrangement, or simply by providing a slot in the outer facing surface 44*a* of box 44 through which the free end of closure flap 48 can fit. In the latter case, the free end of closure flap 48 would taper in width. It will be appreciated that cigarette pack holder 42 can be used to hold other items, such as chewing gum, candy bars, coins, a bus or subway card, etc.

The inner facing surface 44*b* of box 44 can be secured, either permanently or removably, to the outer facing surface of strap 12 by any suitable means, such as the hook and loop fastener arrangement sold under the trademark VELCRO, a snap arrangement, an adhesive, stitching, etc.

Another article holding device of neck wrap/brace 10 is a miscellaneous article holder 50 which is formed as a cylindrical holder 52 having an upper open end 54 into which articles such as coins and monetary bills, pens, pencils, a cigarette lighter, etc. can be placed. A cylindrical cover 56 is provided for fitting over upper open end 54 in order to close the same. Cover 56 can be provided with a central opening 58 for frictionally holding a pen or pencil 60 therein, for ready access without removing cover 56.

It will therefore be appreciated that neck wrap/brace 10 can hold a telephone adjacent a person's ear, as well as hold other items for ready accessability, and can even function as a neck brace for injured persons. Further, the present invention is not limited to the specific article holders disclosed herein, and may include more or less article holders.

In addition, to neck wrap/brace 10, the present invention provides a belt article holder 70 for holding various items, as well as carrying neck wrap/brace 10 when the latter is not in use.

Specifically, belt article holder 70 is formed by a strap 72 of material that is entirely flexible, or which, as with strap 12, can be bent into a desired shape and which remains in that shape until bent again. Strap 72 preferably has a generally constant width along the length thereof, although the present invention is not limited thereto.

Transverse rectangular flaps 74 and 76 that extend from upper and lower edges 78 and 80, respectively, of strap 72, are formed spaced from the opposite second end 72*b* of strap 72. Flap 74 is formed with a patch 82 of loop-type fasteners commonly sold under the trademark VELCRO on the outer surface thereof, while flap 76 is formed with a patch 84 of hook-type fasteners commonly sold under the trademark VELCRO on the inner surface thereof, for releasably connecting with the loop-type fasteners of patch 82.

Further, the outer surface of strap 72 has a patch 86 of loop-type fasteners commonly sold under the trademark VELCRO, provided within flaps 74 and 76. In like manner, the inner surface of strap 72, spaced away from first end 72*a* has a patch 88 of hook-type fasteners commonly sold under the trademark VELCRO thereon, for releasably connecting with patch 86 when belt article holder 70 is wrapped about a person's waist. It will be appreciated that, during such securement, first end 72*a* preferably extends down at a slight angle of about 30 degrees to 60 degrees, and preferably 45 degrees, with respect to second end 72*b*. At such time, flaps 74 and 76 are connected together by patches 82 and 84, to further secure belt 72 around a person's waist.

It will be appreciated that, in such condition, first end 72*a* includes an end extension 72*a*1 that extends outwardly from flaps 74 and 76 in a first direction, and second end 72*b* includes an end extension 72*b*1 that extends outwardly from flaps 74 and 76 in a second direction. First end extension 72*a*1 includes two spaced apart patches 87 and 89 of loop-type fasteners commonly sold under the trademark VELCRO on the inner surface thereof, and in like manner, second end extension 72*b*1 includes two spaced apart patches 90 and 92 of hook-type fasteners commonly sold under the trademark VELCRO on the outer surface thereof, for releasably connecting with patches 87 and 89, such that end extensions 72*a*1 and 72*b*1 form a loop 94 extending outwardly from belt article holder 70.

Figure 10:
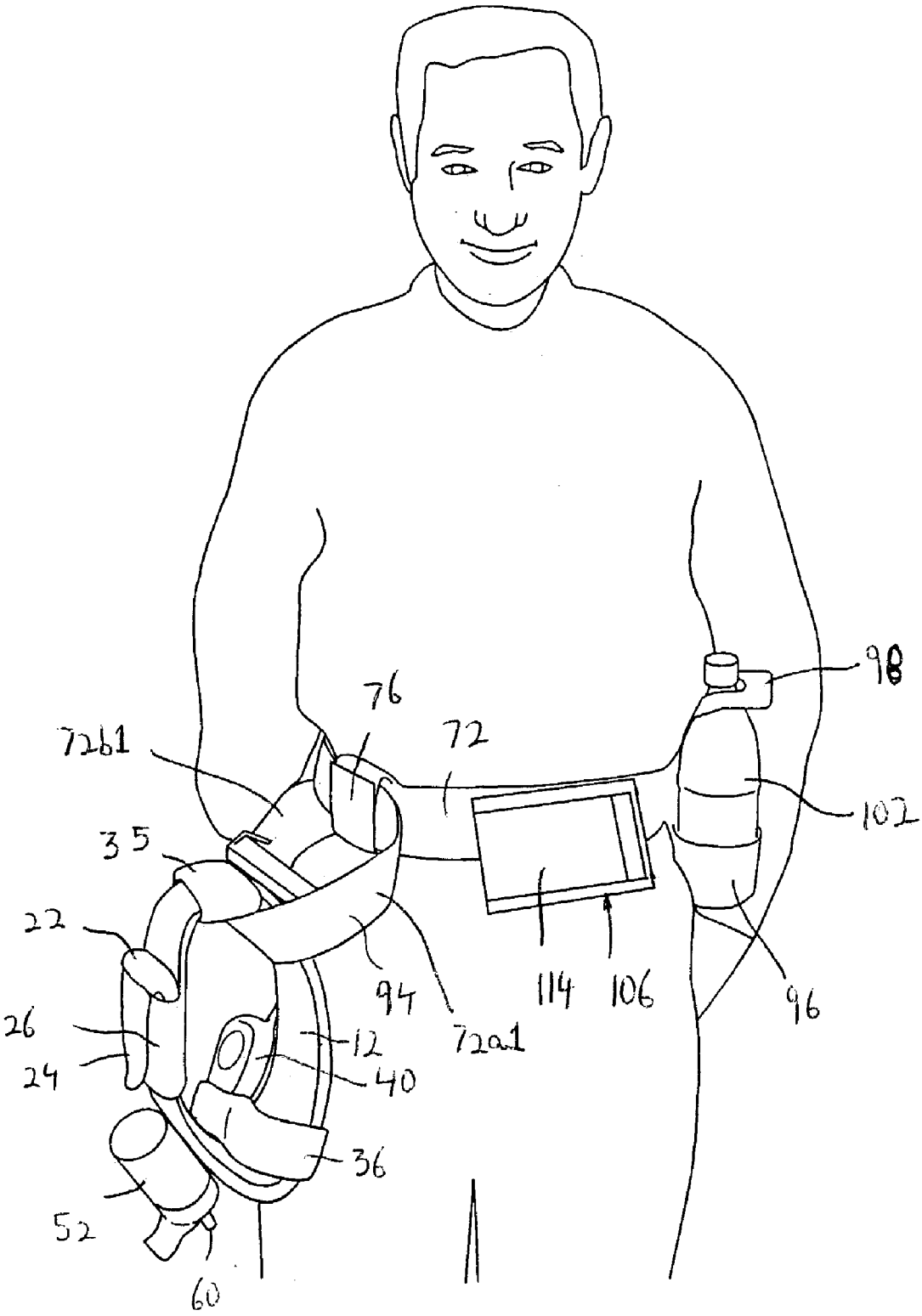
FIG. 10 is a perspective view of the belt article holder being worn by a person, and the neck wrap/brace for holding items being carried by the belt article holder.

As shown in FIG. 10, when neck wrap/brace 10 is not worn by a person, it can be secured in a loop manner by means of hook 22, flaps 24 and 26, and securing band 35, so as to extend through loop 94 and be carried thereby.

Belt article holder 70 further includes various article holding devices secured to strap 72 for holding different articles. Thus, a cup-shaped holder 96 is secured by any suitable means, either permanently or removably, to the outer surface of strap 72 at the lower edge 80 thereof, substantially at a mid-point along the length thereof. A flap 98 is secured to the upper edge 78 of strap 72, immediately above cup-shaped holder 96, and includes a central opening 100 therein. In this manner, a bottle 102 of water, etc. can be held by cup-shaped holder 96 with the neck 104 of bottle 102 being removably inserted through opening 100.

Another article holding device of belt article holder 70 is a pouch/paper pad holder 106 which is removably secured to the outer surface of strap 72. Pouch/paper pad holder 106 includes a pouch formed by inner and outer sheets 110 and 112 secured together at three sides thereof, so as to define an opening 108 at the fourth side for insertion of papers. A paper pad 114 is preferably removably secured to the outer surface of outer sheet 112 of pouch 108 by a slip-in pocket on outer sheet 112, or any other suitable means. The inner surface of inner sheet 110 includes a patch (not shown) of loop-type fasteners commonly sold under the trademark VELCRO, while the outer surface of strap 72 is formed with a patch (not shown) of hook-type fasteners commonly sold under the trademark VELCRO, for releasably connecting with the loop-type fasteners of the first patch.

Thus, with the present invention, neck wrap/brace 10 can be carried by belt article holder 70 when not in use, which belt article holder 70 can also be used for carrying other items.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A neck wrap/brace for holding items, comprising:

a neck strap adapted to be wrapped about a neck of a person;

a securing arrangement for securing together opposite ends of the neck strap in a loop configuration to be wrapped about the neck of the person; and a telephone holder secured to the neck strap and supported solely by said strap, the telephone holder including a mounting member mounted to said neck strap, and a telephone holding member secured to the mounting member and extending above an upper edge of the strap for holding a unitary body telephone having a microphone section and a speaker section adjacent an ear of the person when the neck strap is wrapped about the neck of the person, to enable the person to use the telephone in a hands-free manner.

2. A neck wrap/brace according to claim 1, wherein the strap functions as a neck brace to provide additional support for a head of the person and to restrict movement of the head of the person.

3. A neck wrap/brace according to claim 1, wherein the securing arrangement includes:

a hook at a first end of the strap; and securing flaps at an opposite second end of the strap for securing together around the first end in order to trap the hook, thereby securing together said first and second ends of the strap.

4. A neck wrap/brace according to claim 3, wherein one of the securing flaps includes hook elements and the other of the securing flaps includes loop elements for releasably connecting with said hook elements.

5. A neck wrap/brace according to claim 3, wherein the securing arrangement further includes a band slidably secured around said strap for removably sliding over the secured together flaps.

6. A neck wrap/brace according to claim 1, wherein the telephone holding member includes a band through which a telephone can be frictionally inserted and removably held therein.

7. A neck wrap/brace according to claim 6, wherein said mounting member includes a band slidably mounted on said strap for movement therealong in order to adjust the telephone with respect to a person's ear when the strap is wrapped about the neck of the person.

8. A neck wrap/brace according to claim 1, further comprising at least one additional article holder mounted to the strap.

9. A neck wrap/brace according to claim 8, wherein the at least one additional article holder includes at least one of the following:

a first article holder for holding at least one of money, candy, transportation cards, writing implements and cigarette lighters; and a second article holder for holding a pack of cigarettes.

10. A neck wrap/brace according to claim 9, wherein said at least one additional article holder is releasably secured to the strap.

11. A combination neck wrap/brace for holding items and belt article holder for carrying the neck wrap/brace, comprising:

a neck wrap/brace including:

a neck strap adapted to be wrapped about a neck of a person, a first securing arrangement for securing together opposite ends of the neck strap in a loop configuration to be wrapped about the neck of the person, and a telephone holder secured to the neck strap for holding a telephone adjacent an ear of the person when the strap is wrapped about the neck of the person, to enable the person to use the telephone in a hands-free manner; and a belt article holder including:

a belt strap adapted to be wrapped about a waist of the person, a second securing arrangement for securing together opposite ends of the belt strap in a loop configuration to be wrapped about the waist of the person, and a neck wrap/brace holder on the strap for holding the neck wrap/brace when the neck wrap/brace is not wrapped about the neck of the person.

12. A combination neck wrap/brace and belt article holder according to claim 11, wherein the neck strap functions as a neck brace to provide additional support for a head of a person and to restrict movement of the head of the person.

13. A combination neck wrap/brace and belt article holder according to claim 11, wherein the first securing arrangement includes:

a hook at a first end of the strap; and securing flaps at an opposite second end of the strap for securing together around the first end in order to trap the hook, thereby securing together said first and second ends of the strap.

14. A combination neck wrap/brace and belt article holder according to claim 11, wherein the second securing arrangement includes at least one first fastener at a first end of the second strap and at least one second fastener at a second end of the second strap for securing with said at least one first fastener at a connection position, thereby securing together said first and second ends of the second strap.

15. A combination neck wrap/brace and belt article holder according to claim 14, wherein the at least one first fastener includes hook elements and the at least one second fastener includes loop elements for releasably connecting with said hook elements.

16. A combination neck wrap/brace and belt article holder according to claim 14, wherein the second securing arrangement further includes securing flaps at the second end of the second strap for securing together around the first end of the second strap.

17. A combination neck wrap/brace and belt article holder according to claim 14, wherein the at least one first fastener is spaced away from an edge of said first end of the second strap and the at least one second fastener is spaced away from an edge of the second end of the second strap, such that the first and second ends extend outwardly as first and second end extensions in opposite directions from the connection position.

18. A combination neck wrap/brace and belt article holder according to claim 14, wherein each end extension includes a securing arrangement for releasably connecting with the securing arrangement of the other end extension, to form the neck wrap/brace holder as a loop extension of the strap for holding the neck wrap/brace when the neck wrap/brace is not wrapped about the neck of the person.

19. A combination neck wrap/brace and belt article holder according to claim 11, wherein the telephone holder includes:

a mounting member mounted to said strap; and a telephone holding member for holding the telephone, secured to the mounting member.

20. A combination neck wrap/brace and belt article holder according to claim 19, wherein the telephone holding member includes a band through which a telephone can be frictionally inserted and removably held therein.

21. A combination neck wrap/brace and belt article holder according to claim 20, wherein said mounting member includes a band slidably mounted on said strap for movement therealong in order to adjust the telephone with respect to a person's ear when the strap is wrapped about the neck of the person.

22. A combination neck wrap/brace and belt article holder according to claim 11, further comprising at least one first additional article holder mounted to at least one of:

a) the first strap, and b) the second strap.

23. A combination neck wrap/brace and belt article holder according to claim 22, wherein the at least one additional article holder includes at least one of the following:

a first article holder for holding at least one of money, candy, transportation cards, writing implements and cigarette lighters;

a second article holder for holding a pack of cigarettes;

a third article holder for holding writing paper; and a fourth article holder for holding a bottle.

24. A combination neck wrap/brace and belt article holder according to claim 22, wherein said at least one additional article holder is removably secured to at least one of the first strap and the second strap.

* * * * *